US006062323A

United States Patent [19]

Pusateri et al.

[11] Patent Number: 6,062,323

[45] Date of Patent: May 16, 2000

[54] PNEUMATIC TOOL WITH INCREASED POWER CAPABILITY

[75] Inventors: Daniel S. Pusateri, Grayslake, Ill.; James R. Brehm; Joshua M. Beer, both of Racine, Wis.

[73] Assignee: Snap-on Tools Company, Kenosha, Wis.

[21] Appl. No.: 09/119,683

[22] Filed: Jul. 21, 1998

[51] Int. Cl.[7] ..... B25B 19/00

[52] U.S. Cl. ..... 173/169; 173/218; 173/219; 173/221

[58] Field of Search ..... 173/DIG. 2, 219, 173/169, 168, 170, 218, 221, 159; 181/230, 254; 251/290, 305

[56] References Cited

U.S. PATENT DOCUMENTS

| | | | |
|---|---|---|---|
| 2,813,514 | 11/1957 | Von Seggern | 173/169 |
| 3,799,499 | 3/1974 | Shur | 251/290 |
| 3,802,538 | 4/1974 | Brown | 181/230 |
| 3,809,179 | 5/1974 | Delaney, Jr. et al. | 181/230 |
| 3,823,795 | 7/1974 | Fleigle | 173/DIG. 2 |
| 3,833,068 | 9/1974 | Hall | 173/169 |
| 3,989,113 | 11/1976 | Spring, Sr. et al. | 173/221 |
| 3,993,159 | 11/1976 | Amador | 181/230 |
| 4,042,062 | 8/1977 | Tooley | 181/230 |
| 4,068,987 | 1/1978 | Crooks | 181/230 |
| 4,105,080 | 8/1978 | Gunning | 173/66 |
| 4,109,735 | 8/1978 | Bent | 173/221 |
| 4,113,052 | 9/1978 | McElroy, Jr. | 181/230 |
| 4,161,996 | 7/1979 | Dolejsi | 181/230 |
| 4,205,732 | 6/1980 | Auerbach et al. | 181/230 |
| 4,236,589 | 12/1980 | Griffith | 173/169 |
| 4,773,487 | 9/1988 | Ringer | 173/170 |
| 4,962,787 | 10/1990 | Mayhew | 173/170 |
| 4,977,966 | 12/1990 | Farber et al. | 173/159 |
| 5,376,762 | 12/1994 | Kimberlin | 181/230 |
| 5,500,494 | 3/1996 | Ligman | 181/230 |
| 5,581,055 | 12/1996 | Self et al. | 181/230 |
| 5,591,070 | 1/1997 | Kachich | 173/169 |
| 5,901,794 | 5/1999 | Schoeps et al. | 173/169 |

*Primary Examiner*—Peter Vo
*Assistant Examiner*—Jim Calve
*Attorney, Agent, or Firm*—Seyfarth, Shaw, Fairweather & Geraldson

[57] ABSTRACT

A pneumatic tool includes a housing defining an air inlet and first and second exhaust passages and an air motor fluidly coupled to the air inlet and disposed in the housing. The motor produces exhaust air in operation and is fluidly coupled to the first and second exhaust passages. The tool also includes an exhaust valve carried by housing for selectively opening and closing only the second exhaust passage.

13 Claims, 5 Drawing Sheets

PNEUMATIC TOOL WITH INCREASED POWER CAPABILITY

BACKGROUND OF THE INVENTION

1. Field of the Invention

This invention relates to pneumatic power tools, and more particularly, to exhaust systems for such tools.

2. Description of the Prior Art

In the past, pneumatic power tools have been very noisy. Tools with muffled exhaust have been provided, but a muffled exhaust causes back pressure which decreases the power of the tool. This power decrease often makes it difficult to perform jobs requiring high power.

Such tools have been provided with exhaust diverting valves to allow exhaust air to bypass the muffled exhaust outlet and vent to a second exhaust outlet. These valves, however, either totally or partially block the muffled exhaust outlet thereby not allowing exhaust air to easily flow out of both exhaust outlets and preventing the full power of the tool from being realized.

SUMMARY OF THE INVENTION

It is a general object of the invention to provide an improved pneumatic tool, while affording additional structural and operating advantages.

An important feature of the invention is the provision of a pneumatic tool which is of relatively simple and economical construction.

A further feature of the invention is the provision of a tool of the type set forth which can easily be operated by right or left-handed users.

A still further feature of the invention is the provision of a tool of the type set forth, which includes an exhaust valve which prevents back-pressure build-up and allows the exhaust air from the motor of the tool to flow substantially obstruction-free from an exhaust outlet, thereby providing a tool with more power.

One or more of these features may be attained by providing a pneumatic tool including a housing defining an air inlet and first and second exhaust passages and an air motor disposed in the housing and fluidly coupled to the air inlet and first and second exhaust passages. The motor passes exhaust air to the exhaust passages in operation. The tool also includes an exhaust valve carried by the housing for selectively opening and closing only the second exhaust passage.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
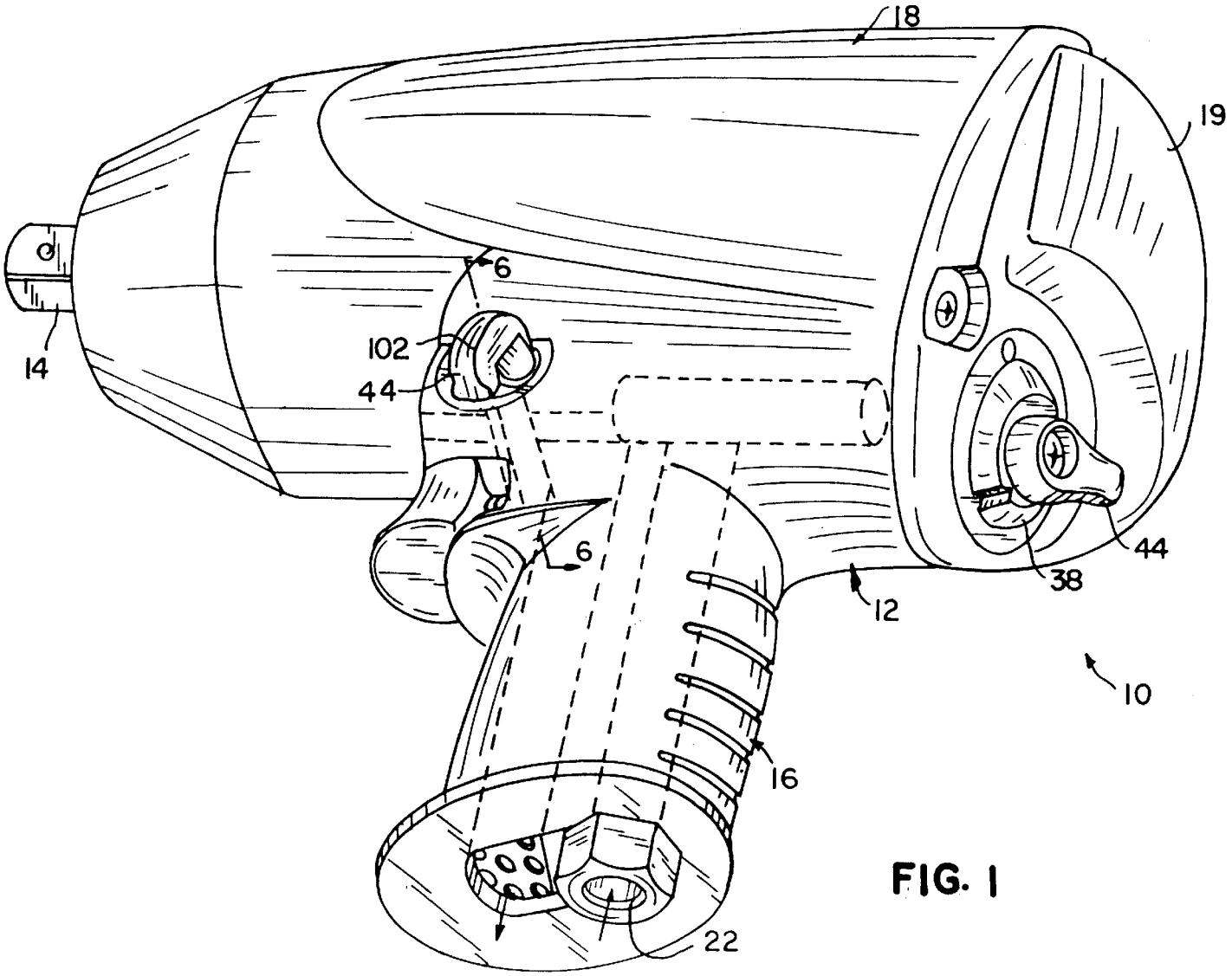
FIG. 1 is a perspective view of the pneumatic tool of the present invention.
Figure 2:
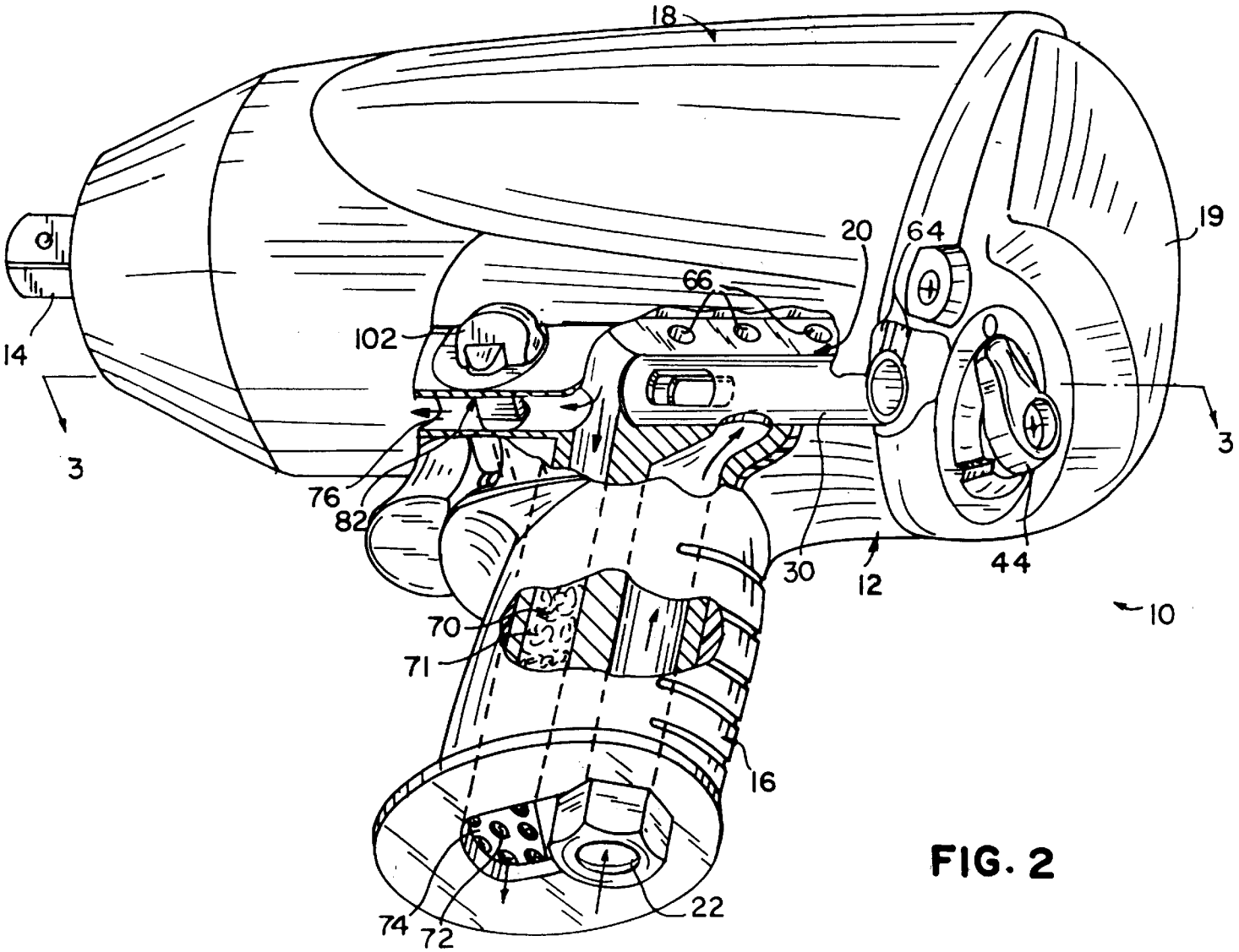
FIG. 2 is a view similar to FIG. 1, with portions broken away and with the reverse and exhaust valves in different positions

Referring to FIGS. 1 and 2, a pneumatic tool 10, such as an impact wrench, is shown. The pneumatic tool 10 includes a housing 12. A drive assembly 14 extends from a front portion of the housing 12. Drive assembly 14 releaseably couples to a socket, or the like (not shown). Housing 12 includes a handle portion 16, a drive portion 18 and an end cap 19. An air motor 20 (FIG. 2) is disposed in the drive portion 18 of the housing 12.

Motor 20 is powered by a pressurized air source coupled to an air inlet 22 disposed in the handle portion 16. The air inlet 22, as discussed below, is fluidly coupled to the motor 20. In use, the motor 20 produces exhaust air.

Figure 3:
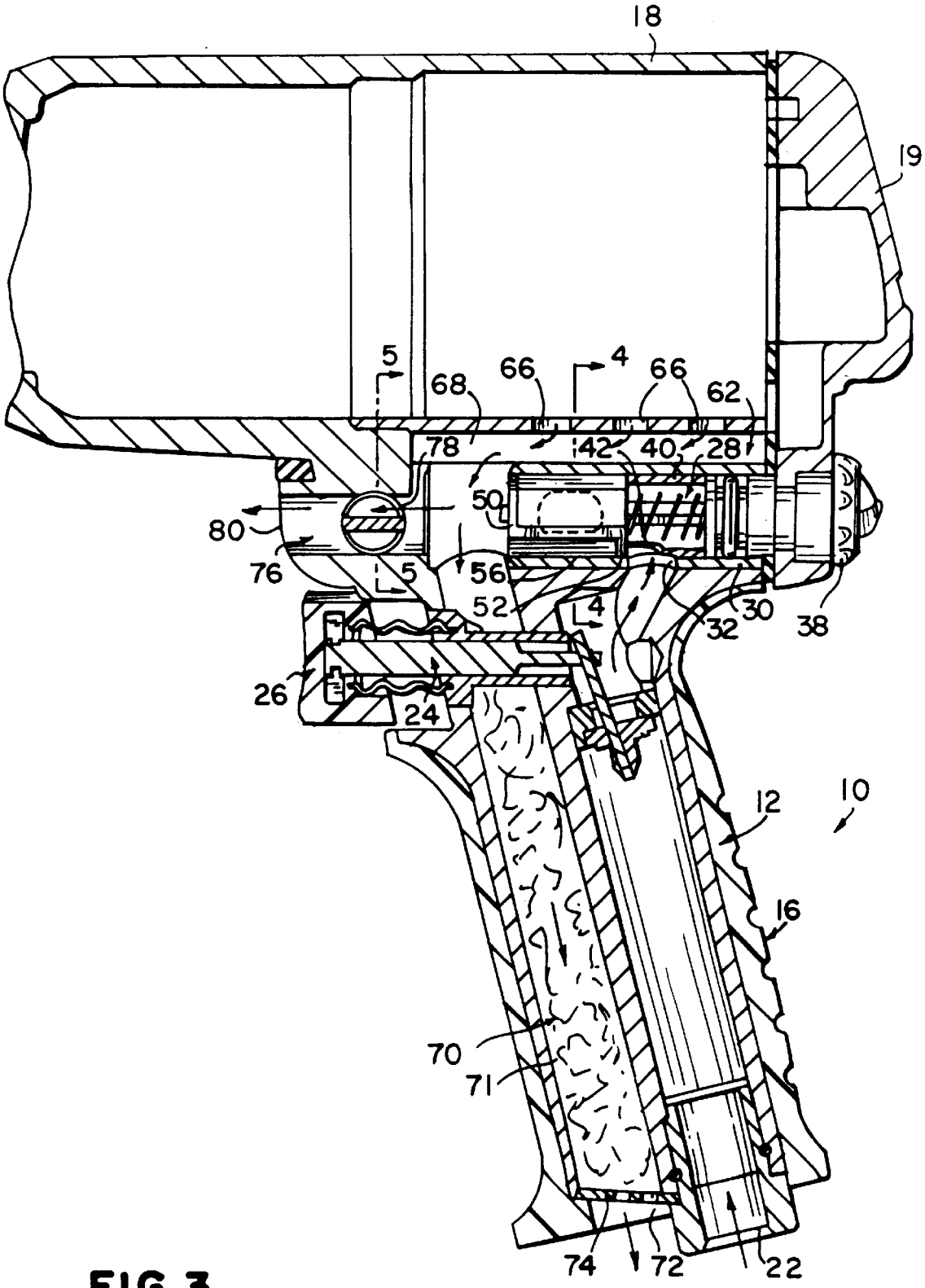
FIG. 3 is a fragmentary sectional view taken generally along the line 3—3 of FIG. 2 with all but the bottom housing portion of the motor removed.

As seen in FIG. 3, the amount of air sent to the motor 20 to control its power output is regulated by a throttle mechanism 24, which includes a trigger 26 coupled to a tip valve 28. The operation of the throttle mechanism 24 is more fully disclosed in copending patent application Ser. No. 09/044,942, entitled "Tip Valve for Pneumatic Tool", the specification of which is incorporated herein by reference.

Figure 7:
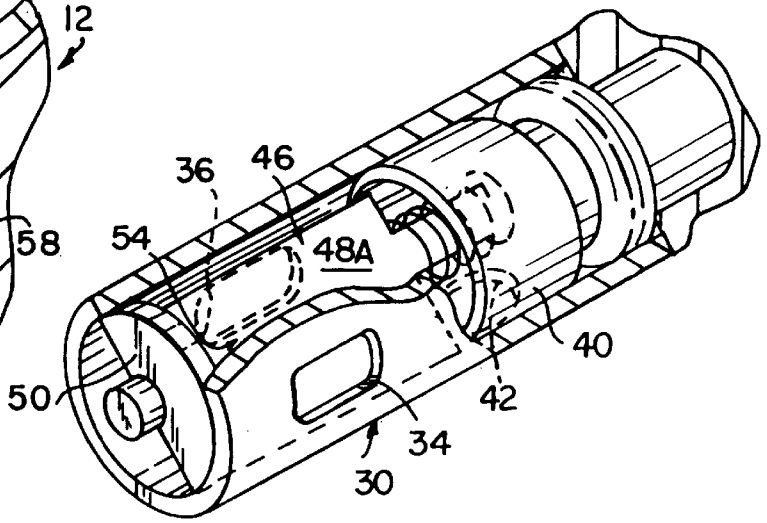
FIG. 7 is an enlarged, fragmentary, perspective view, partially in section, of the reverse valve structure controlling the flow of both inlet and exhaust air in the tool of FIG. 1.
Figure 4A:
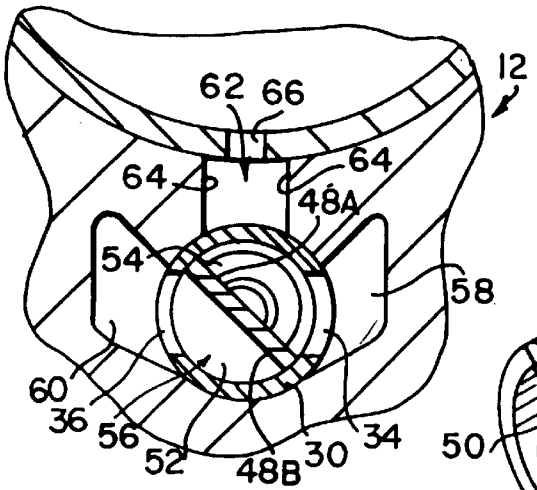
FIG. 4A is a an enlarged, fragmentary, sectional view taken generally along line 4—4 of FIG. 3.
Figure 4B:
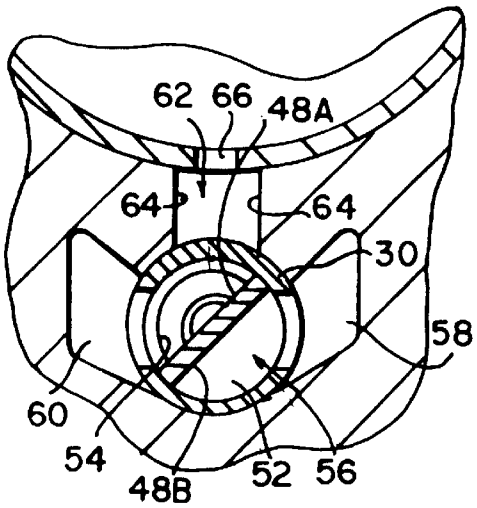
FIG. 4B is a view similar to FIG. 4A, with the reverse valve moved to its other position.

As seen in FIGS. 3 and 7, the air inlet 22 is fluidly coupled to a reverse valve mechanism 28, which controls the flow of both secondary exhaust from the motor (as discussed below) and of incoming air to power the motor 20 to rotate the drive assembly 14 either clockwise or counterclockwise, in a known manner. The reverse valve mechanism 28 includes a cylindrical bushing 30 having an inlet 32 and two apertures, or air passages 34, 36 (see FIG. 7). The reverse valve mechanism 28 also includes a selector disk 38 disposed outside the housing 12 and coupled to a rotatable, cylindrical, interior, bushing 40 (FIGS. 3 and 7) disposed in bushing 30. The interior bushing 40 is variably recessed at one end to define an inlet 42 (FIG. 3) communicating with inlet 32 of bushing 30. The reverse valve mechanism 28 also includes a rotatable selector switch 44 moveable between two positions to direct air flow in one of two directions to the motor 20 to determine the rotation of drive assembly 14. The selector switch 44 is coupled to a valve member 46. Valve member 46 includes an elongated planar portion 48 having two sides 48A, 48B, (FIGS. 4A, 4B) and two semicircular walls 50, 52 respectively disposed at opposite longitudinal ends and opposite sides 48A, 48B of the planar portion 48. Wall 48A of planar portion 48, semicircular walls 50 and bushing 30 form a moveable air inlet chamber 54, and wall 48B of planar portion 48, semicircular wall 52 and bushing 30 form a moveable exhaust air chamber 56, discussed further below. When the rotatable selector switch 44 is in the position shown in FIG. 2, the valve member 46 is in the position shown in FIGS. 3, 4A and 7, and the air inlet chamber 54 is in fluid communication with air passage 34, and the exhaust air chamber 56 is in fluid communication with air passage 36. When the rotational selector switch 44 is in the position shown in FIG. 1, the valve member 46 is in the position shown in FIG. 4B, and the air inlet chamber 54 is in fluid communication with air passage 36, and the exhaust air chamber 56 is in fluid communication with air passage 34.

The tool 10 also includes air passages 58, 60 (FIGS. 4A and 4B) respectively formed by outer surface portions of bushing 30 and grooves formed in the housing 12. Air passages 58, 60 are, respectively, fluidly coupled to air passages 34, 36, and to either air inlet chamber 54 or exhaust air chamber 56, depending on the position of selector switch 44. The air passages 58, 60 run substantially the length of the bushing 30 and are fluidly coupled to the motor 20 by air passages in the end cap 19 to either supply pressurized air to the motor 20 or remove secondary exhaust from the motor 20, in a known manner.

The housing 12 also includes a primary exhaust air passage 62 formed by the bottom of the motor 20, the top of the bushing 30 and two spaced-apart opposed walls 64 in the housing 12 (FIGS. 4A and 4B) disposed between the bushing 30 and motor 20.

The bottom of the motor 20 includes three apertures 66 (FIGS. 2, 3, 4A and 4B) which expel primary exhaust air from the motor 20 into the primary exhaust air passage 62. The motor 20 also expels secondary exhaust air. The secondary exhaust flows to the exhaust air passage 56 through air passages coupled to either air passage 58 or 60, depending on the position of selector switch 44.

As seen in FIG. 3, the primary exhaust air passage 62 and the exhaust air chamber 56 are both fluidly coupled to an exhaust receiving chamber 68 which thus receives primary and secondary exhaust air. The exhaust receiving chamber 68 is fluidly coupled to a tubular primary exhaust air chamber (or passageway) 70 disposed in the handle portion 16. The exhaust air chamber 70 has a muffler material 71 disposed therein to quiet the tool 10 during operation. The primary exhaust air chamber 70 also has an outlet 72 and an apertured plate 74 to maintain the muffler material 71 within the first exhaust air chamber 70, yet allow exhaust air to pass out of the tool 10.

The exhaust receiving chamber 68 is also fluidly coupled to an elongated, tubular secondary exhaust air chamber (or passageway) 76, having an axis A (FIG. 3), an inlet 78 and an outlet 80. When not blocked, as described below, exhaust air flows substantial along the path of axis A.

Figure 6:
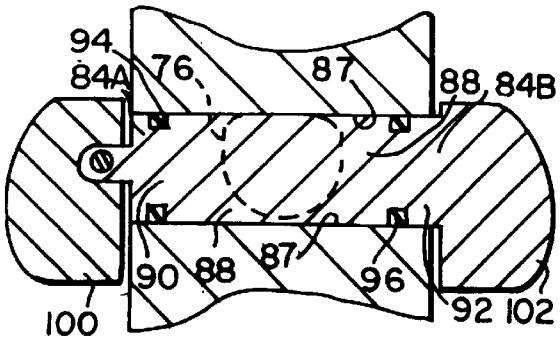
FIG. 6 is a view similar to FIG. 5, with the exhaust valve in a closed condition.
Figure 5:
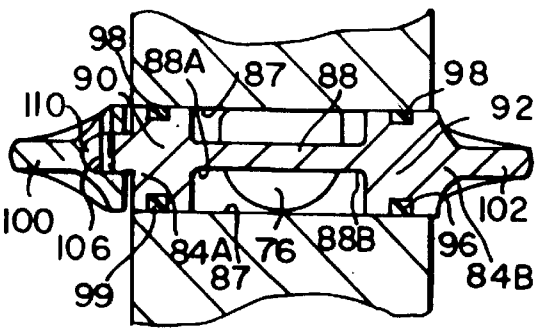
FIG. 5 is an enlarged, fragmentary, sectional view taken generally along line 5—5 of FIG. 3, showing the exhaust valve of the present invention in a fully open condition.

An exhaust valve 82 is carried by the housing 12 within the secondary exhaust air chamber 76. The exhaust valve 82 includes a valve member 84 having first and second longitudinal ends 84A, 84B (FIGS. 5 and 6). The valve member 84 is partially disposed in a bore 86 defined in part by walls 87 in the housing 12, which has an axis B substantially perpendicular to both the axis A of the secondary exhaust air chamber 76 and the flow of exhaust air through the secondary exhaust air chamber 76. The wall forming the bore 86 acts a valve seat for the valve member 84. The valve member 84 includes a platelike member 88 having first and second longitudinal ends 88A, 88B (FIG. 5) integral with two cylindrical members 90, 92, respectively disposed at the first and second longitudinal ends 82A, 82B of the valve member 84.

The cylindrical members 90, 92 respectively have arcuate grooves 94, 96 disposed about their periphery and o-rings 98 respectively disposed therein.

Figure 8:
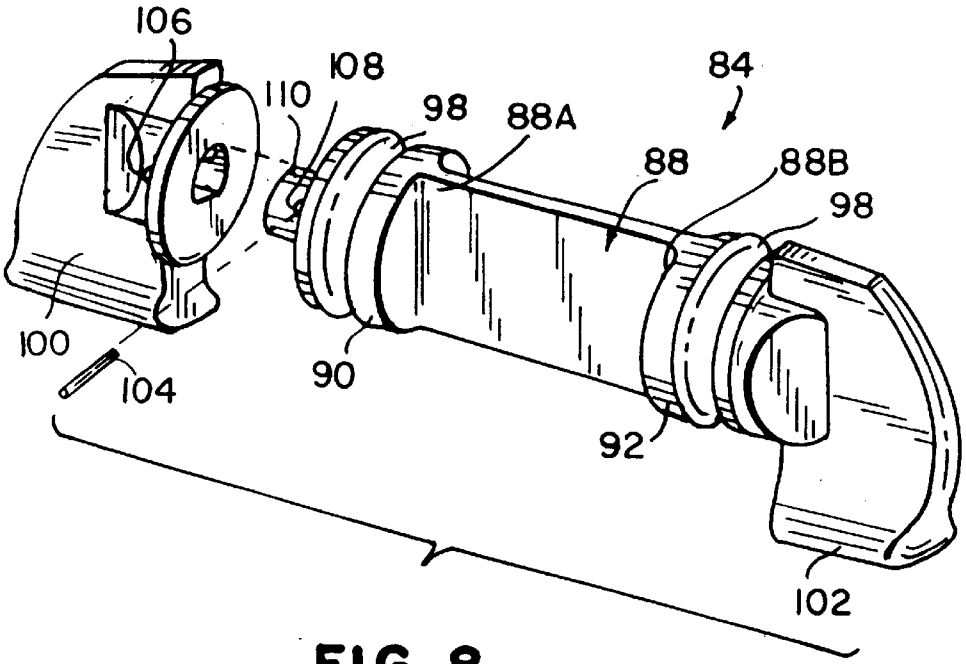
FIG. 8 is an enlarged, exploded view of the exhaust valve member and selector therefor.

As best seen in FIG. 8, the exhaust valve 82 also includes two knobs 100, 102 for a user to open and close the valve 82. Knobs 100, 102 are respectively coupled to first and second longitudinal ends 84A, 84B of the valve member 84. Knob 100 being integral with valve member 84 and knob 102 coupled to valve member 84 by a pin 104 running through an aperture 106 in knob 100 and an aperture 108 in an extension 110 of cylindrical member 92.

Figure 9:
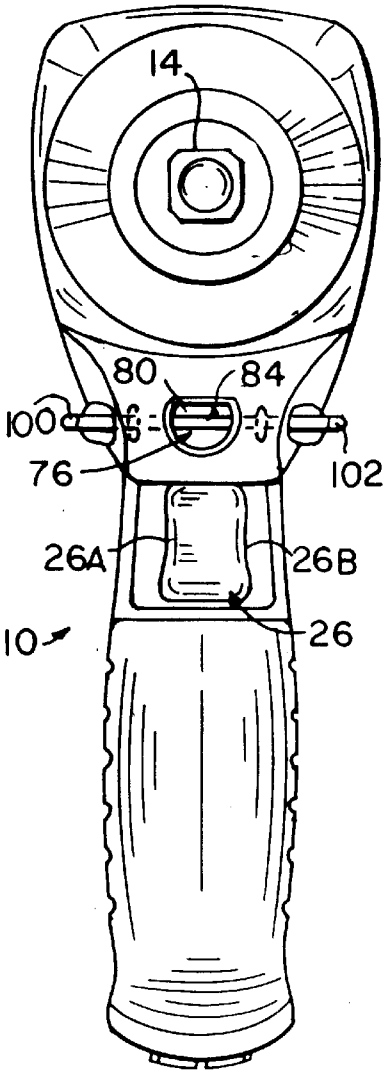
FIG. 9 is a front elevational view of the pneumatic tool of FIG. 2.

As seen best in FIG. 9, the trigger 26 has first and second lateral sides 26A, 26B. Knobs 100, 102 are disposed above trigger 26 and respectively outboard of lateral sides 26A, 26B. The disposal of the knobs 100, 102, in this manner, allow a user to easily access the knobs 100 or 102 with whatever hand is not operating the tool 10.

As seen in FIGS. 1 and 6, when the plate-like member 88 is perpendicular to the axis of the secondary exhaust air chamber 76 it forms a seal with the walls 87 and the valve 82 is in a closed position to prevent the flow of the exhaust air out of the secondary exhaust air chamber 76. In the closed position, all the exhaust air flows through the first exhaust air chamber 70 and muffler material 71. The muffler material 71 causes back pressure, thereby preventing the incoming pressurized air from fully powering the motor.

When a user needs maximum power from the motor 20, the user opens valve 82 by simply rotating valve member 84 via either or both knobs 100, 102 about axis B to a fully open position, such as shown in FIGS. 2, 3, 5 and 9. In this position, the plane of the plate-like member 88 is substantially parallel to axis A (FIG. 3). In this position, most, if not all, of the exhaust air flows substantially unobstructed out of the outlet 80 of the secondary exhaust air chamber 76 and bypasses the primary exhaust air chamber 70. Since the secondary exhaust air chamber 76 does not create much, if any, back pressure, more incoming pressurized air can advantageously flow through the motor at a higher pressure to provide more power. It will be appreciated that if desired, the exhaust valve 82 could also be moved to intermediate or partially open positions.

As seen in FIG. 9, the outlet 80 of the secondary exhaust air chamber 76 is sized and dimensioned to allow a user to determine whether the valve member 84 is in an open or closed position.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A pneumatic tool comprising:

a housing defining an air inlet, a first exhaust passage, and a second elongated exhaust passage having a first axis and fluidly coupled to the first passage;

an air motor disposed in the housing and fluidly coupled to the air inlet and the first and second exhaust passages, the motor producing exhaust air in operation; and an exhaust valve spaced from the first exhaust passage and carried by the housing for selectively closing and opening only the second exhaust passage, the exhaust valve including a valve seat and a valve member rotatable about a second axis fixed with respect to the second exhaust passage and transverse to the first axis, the valve member being moveable between a closed position, wherein the valve seat and valve member form a seal preventing the exhaust air produced by the motor from flowing through the second exhaust passage, and a fully open position, allowing maximum flow of exhaust air out of the second exhaust passage.

2. The tool of claim 1, wherein the valve member includes a platelike portion having first and second longitudinal ends.

3. The tool of claim 2, wherein the valve member includes a first arcuate groove disposed adjacent the first longitudinal end and a second arcuate groove disposed adjacent the second longitudinal end, and a first o-ring disposed in the first arcuate groove and a second o-ring disposed in the second arcuate groove.

4. The tool of claim 1, wherein the exhaust valve further includes a valve selector disposed outside the housing and coupled to the valve member for rotating the valve member.

5. The tool of claim 4, wherein the valve member has a length and first and second longitudinal ends, and the valve selector including a first knob coupled to the first longitudinal end and a second knob coupled to the second longitudinal end.

6. The tool of claim 5 and further comprising an inlet valve for controlling the amount of air to be supplied to the motor from the air inlet, the inlet valve including a trigger operating member disposed outside the housing, the trigger operating member having first and second lateral sides, wherein the first knob is disposed laterally outside of the first lateral side and the second knob is disposed laterally outside of the second lateral side.

7. The tool of claim 1, wherein the housing has an exterior surface and the second exhaust passage terminates at an outlet disposed at the exterior surface and is sized and dimensioned to allow a user to determine whether the valve member is in the open position or the closed position.

8. The tool of claim 1, and further comprising a muffler material disposed in the first exhaust chamber.

9. The tool of claim 1, wherein the pneumatic tool is an impact wrench.

10. A pneumatic tool comprising:

a housing defining an air inlet, a first exhaust passage, and a second elongated exhaust passage having a first axis and fluidly coupled to the first passage;

an air motor disposed in the housing and fluidly coupled to the air inlet and the first and second exhaust passages, the motor producing exhaust air in operation; and an exhaust valve carried by the housing for selectively closing and opening only the second exhaust passage, the exhaust valve including a valve seat and a valve member rotatable about a second axis fixed with respect to the second exhaust passage and transverse to the first axis, the valve member being moveable between a closed position, wherein the valve seat and valve member form a seal preventing the exhaust air produced by the motor from flowing through the second exhaust passage, and a fully open position, allowing maximum flow of exhaust air out of the second exhaust passage, the exhaust valve being spaced from the first exhaust passage in all positions.

11. The tool of claim 10, wherein the second axis is disposed in the second exhaust passage.

12. A pneumatic tool comprising:

a housing defining an air inlet, a first exhaust passage, and a second elongated exhaust passage having a first axis and fluidly coupled to the first passage;

an air motor disposed in the housing and fluidly coupled to the air inlet and the first and second exhaust passages, the motor producing exhaust air in operation; and an exhaust valve spaced from the first exhaust passage and carried by the housing so that at least a portion of the exhaust valve is disposed within the second exhaust passage for selectively closing and opening only the second exhaust passage, the exhaust valve including a valve seat and a valve member rotatable about a second axis fixed with respect to the second exhaust passage and transverse to the first axis, the valve member being moveable between a closed position, wherein the valve seat and valve member form a seal preventing the exhaust air produced by the motor from flowing through the second exhaust passage, and a fully open position, allowing maximum flow of exhaust air out of the second exhaust passage.

13. The tool of claim 12, wherein the exhaust valve is totally disposed within the second exhaust passage.

* * * * *